United States Patent [19]

Brown

[11] 4,056,162

[45] Nov. 1, 1977

[54] OPERATING MECHANISM FOR OVERLAPPING PANELS TYPE DOORWAY CLOSURES

[75] Inventor: Richard L. Brown, Bellevue, Nebr.

[73] Assignee: Lo-Rise Elevator Company, Plattsmouth, Nebr.

[21] Appl. No.: 766,266

[22] Filed: Feb. 7, 1977

[51] Int. Cl.[2] ..... B66B 13/08

[52] U.S. Cl. ..... 187/52 R; 49/101; 49/359

[58] Field of Search ..... 187/51, 52 R, 56, 58; 49/100, 101, 118, 120, 122, 359

[56] References Cited

U.S. PATENT DOCUMENTS

| | | | |
|---|---|---|---|
| 2,077,659 | 4/1937 | Bancroft | 187/52 R |
| 2,637,549 | 5/1953 | Borden | 49/100 X |
| 2,929,622 | 3/1960 | Thorson | 49/122 |
| 3,406,484 | 10/1968 | Atkey et al. | 187/52 R X |

*Primary Examiner*—John J. Love
*Assistant Examiner*—James L. Rowland
*Attorney, Agent, or Firm*—George R. Nimmer

[57] ABSTRACT

Operating mechanism for doorway closures of the rollably suspended overlapping and interdependently laterally moving two panels type. The operating mechanism comprises a transversely extending shaft which is powerably turnable in both angular directions and which is laterally co-movably mounted to the slower near-panel. There is a dual-arms lever which at its medial turning-point is co-turnably attached to the transverse shaft and is laterally co-movable with the near-panel. A far-link has its ends respectively pivotably attached at a lofty elevation of the far-panel and to the lever second-arm a judicious finite-distance from the turnable shaft, and a near-link has its ends respectively pivotably attached to the lever first-arm and at a lofty immovable-location of the doorway nearward framework. For the accordingly interdependently laterally movable overlapping closure panels, there are stop means to limit turning of the transverse shaft and lever in both angular directions as the panels approach fully-open and fully-closed positions across the doorway opening.

9 Claims, 5 Drawing Figures

OPERATING MECHANISM FOR OVERLAPPING PANELS TYPE DOORWAY CLOSURES

Illustrating typical background environment of this invention for overlapping panels type doorway closures, reference may be had to drawing FIG. 1 carrying the legend "Priot Art". Doorway openings 10 are defined by some suitable stationary surrounding framework such as a wall 10W, herein extending upwardly from a building horizontal floor "BF". Doorway opening 10 includes an upright far-jamb 10F and upright near-jamb 10N that define therebetween the doorway lateral-extent "LE" (from 10A to 10B). The doorway vertical height "VH" (from 10C to 10D) is defined by floor "BF" and header 10H of wall 10W. Analagously, the doorway 10 might be that for an elevator car having a floor "BF", roof "BR", far-jamb 10F(terminating at 10FF), and laterally extensive near-jamb 10N(terminating at 10NN).

Overlapping panels type doorway closures (e.g."PC") aredefined in the prior art to mean those wherein two parallel upright panels 20 and 30 might move interdependently in the same lateral direction across a doorway 10. Specifically, as indicated in FIG. 1 phantom line, both panels 20 and 30 would be alongside near-jamb 10N and have their lead-ends 21 and 31 aligned at near-edge 10B when doorway 10 is fully-open. However, as indicated in solid line, panels 20 and 30 are laterally extendable toward the far-jamb 10F when doorway 10 is fully-closed. In the "closed" doorway, the laterally faster movable far-panel 30 has its lead-end 31 assuming proximity to far-edge 10A; too, slower moving near-panel 20 tends the nearwarddoorway portion and having its trail-end 22 in proximity to near-edge 10B. Moreover, in "closed" condition, near-panel lead-end 21 overlaps far-panel trail-end 32 by an inch or so.

For such overlapping panels type doorway closures "PC", the respective panels 20 and 30 are customarily rollably suspended from a pair of horizontal overhead parallel rails 29 and 39 attached at fixed elevation to the framework at header 10H. Each rail extends across doorway lateral-extend "LE" and necessarily generously nearwardly beyond doorway near-edge 10B (as indicated at 29A and 39A) to permit the retracted panels "open" condition alluded to in FIG. 1 phantom line. In order to allow the overlapping panels to move in the same lateral direction at different speeds between "open" and "closed" doorway conditions, one of the overhead rails is spaced a transverse-gap from the other rail, herein front-rail 39(for farpanel 30) being indicated transversely frontally of rail 29(for near-panel 20). Normally, rails 29 and 39 are at substantially coelevation as in FIGS. 2–5; but in FIG. 1, for purposes of orientation, rails 29 and 39 are shown at slightly different elevations. Near-panel 20 has upwardly extending hangers 27A and 27B carrying rollers 28 for engaging rail 29, and similarly, far-panel 30 has hangers 37A and 37B carrying rollers 38 for engaging rail 39. Each panel has a center-of-mass "CM" located in elevation below its rail, which location "CM" is ordinarily practically synonymous with the panel mid-height. Each panel has a lateral width "LW" (e.g. 21–22, 31–32), and for practical working purposes bears a ratio in the range of one-third to two-thirds doorway lateral-extent "LE". More desirably, especially in elevator cars where there are spatial constraints, this ratio is within the range of four-ninths to five-ninths. Ideally therefor, the lateral width of panels 20 and 30 are about the same whereby each panel might tendably close about one-half the doorway lateral-extent "LE" and the operating mechanism (40) of the present invention is most advantageously employable.

Operating mechanisms of the prior art for furnishing interdependently lateral movement of the closure overlapping panels suffer from one or more disadvantages and deficiencies. Some prior art operating mechanisms rely primarily upon linkages attached to and operatively extending from the doorway framework to lower regions of the two-panels closure (e.g. "PC"). Such types mechanisms necessitate very complicated systems involving very lengthy linkages which are unsightly, spatially cumbersome, and have a tendency during use to misalign whereby the operating mechanism becomes unreliable. Other prior art operating mechanisms depend upon exceedingly complicated variable-control motors, pulley arrays, and elaborate power transmissions for the door closure panels, which systems are relatively expensive both initially and for maintenance.

It is accordingly the general object of the present invention to provide operating mechanisms for doorway closures of the overlapping and rollably suspended panels type, which overcomes disadvantages and deficiencies of prior art mechanisms and which are adaptable both for building wall doorways and for doorways of elevator cars. It is an ancillary objective to provide simple and reliable operating mechanism which provide doorway "open" and "closed" conditions exceedingly quickly, yet terminate the closure panels lateral travel at safe and slowing-down speeds.

With the above and other objects and advantages in view, which will become more apparent as this description proceeds, the doorway closure operating mechanisms of the present invention generally comprise; a transversely extending shaft which is actuatably turnable in both angular directions and which is at fixed elevation which at its medial turning-point is co-turnably attached to the transverse shaft; a far-link having its two ends respectively pivotably attached at a lofty elevation of the far-panel and to the lever second-arm a judicious finite-distance from the turnable transverse shaft; a near-link having its two ends respectively pivotably attached to the lever first-arm and at a lofty immovable-location of the doorway nearward framework; and stop means to limit turning of the shaft and lever in both angular directions as the accordingly interdependently laterally movable panels approach fully-open and fully-closed positions across the doorway opening.

In the drawing, wherein like characters refer to like parts in the several views, and in which:

FIG. 1 as aforedescribed is an elevational view of a typical prior art environment for the doorway closure operating mechanism of the present invention.

Figure 1:
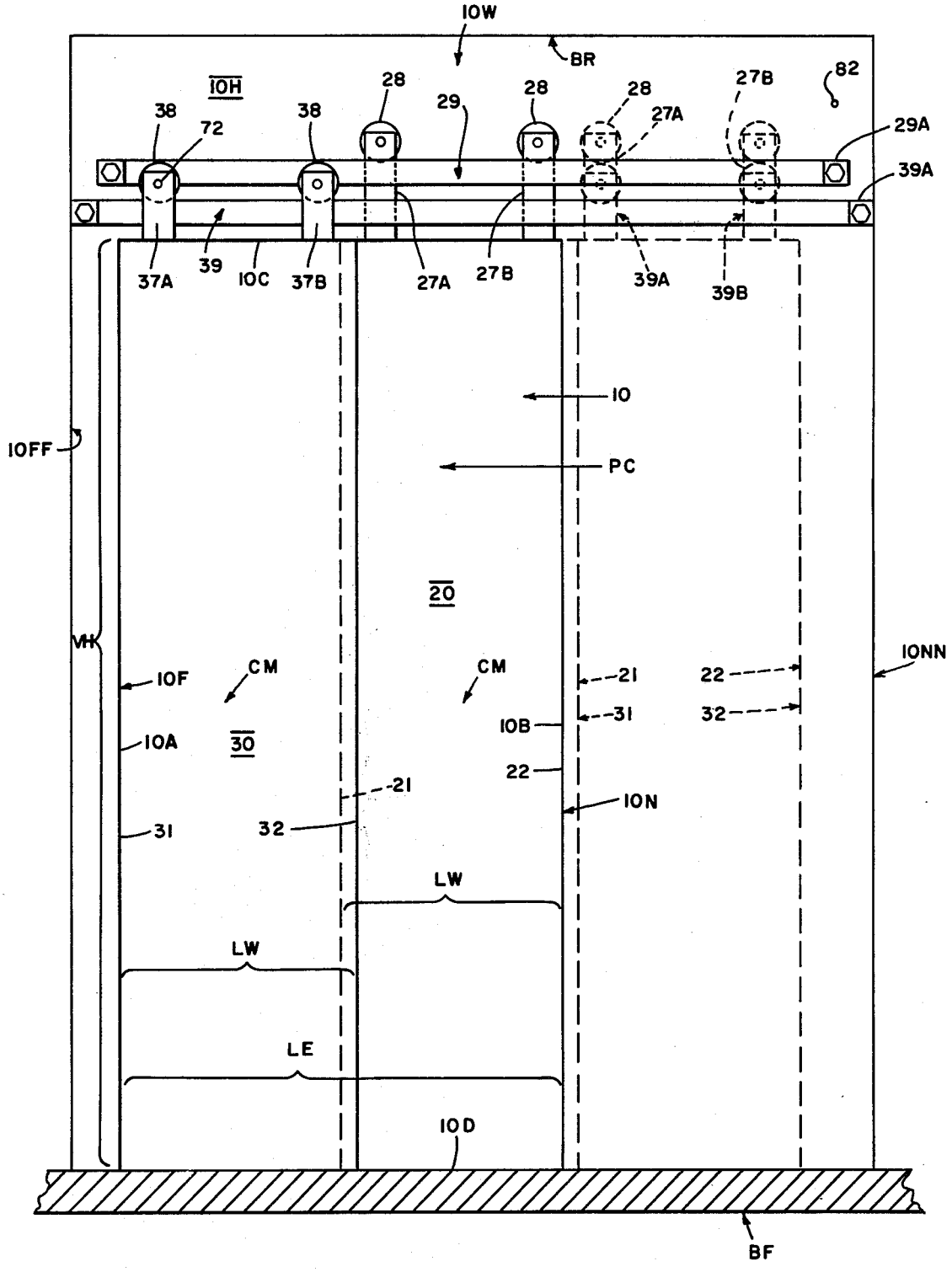
FIG. 1 PRIOR ART
Figure 2:
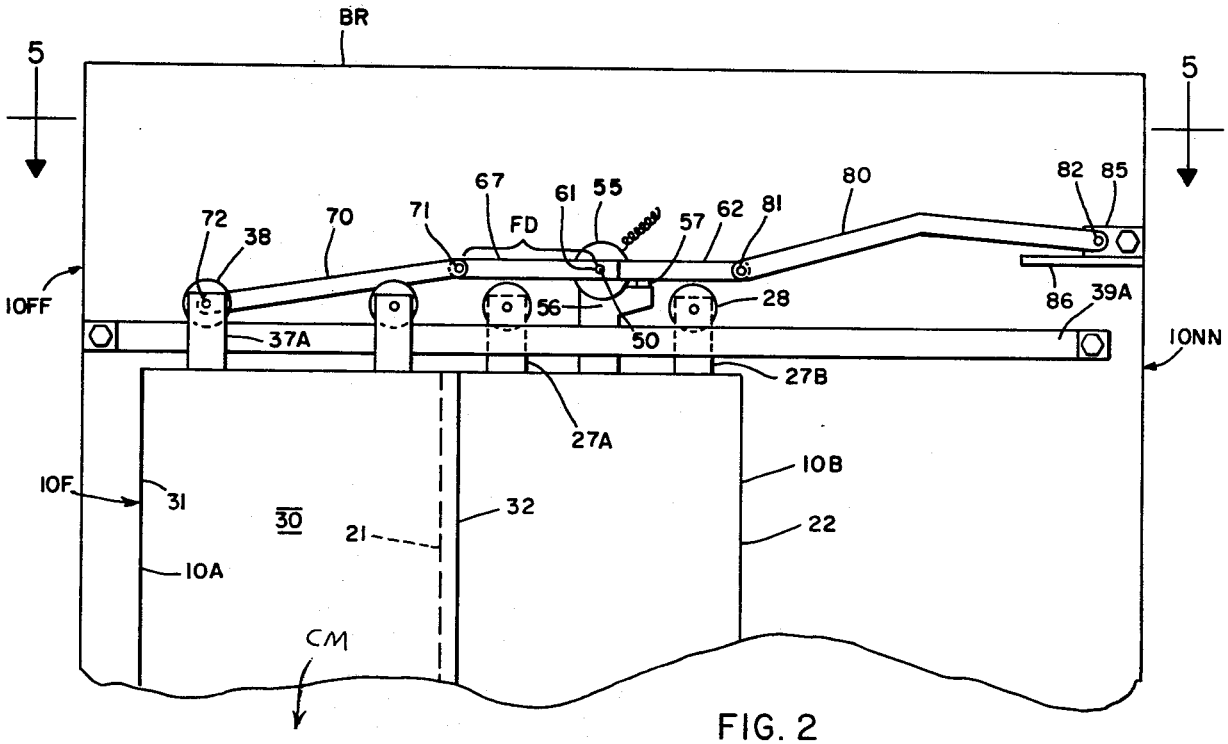
FIG. 2 is a side elevational view analagous to upper portions of FIG. 1 at "fully-closed" doorway condition and including thereat a representative embodiment of the operating mechanism of the present invention.

Referring now to FIGS. 2–5, the operating mechanism embodiment 40 generally comprises a transverse shaft 50 extending along a horizontal transverse-axis which is herein shown as substantially perpendicular to the vertical planes of panels 20 and 30 and doorway 10. Transverse shaft 50 is associated with a lofty elevation of (and hence laterally co-movable with) near-panel 20, and wherein shaft 50 is turnable in both angular directions about its transverse-axis. There are dual-directional powering means for turning the transverse shaft 50 in both angular directions; although said powering means might take several forms and including even a handcrank, conventional dual-directional motors (e.g. 55) attached to (and hence laterally co-movable with) near-panel 20 are preferred. In such cases, the transverse shaft 50 might be the integral rotary shaft of electric motor 55. Such motor 55 is herein shown mounted upon a pedestal 56 atop near-panel 20 between its hangers 27A and 27B, pedestal 56 being provided with a forwardly extending transverselip 57. For reasons to be explained later in greater detail, constantspeed type gear reversible type electric motors (55) are preferred, which motor shaft 50 is depicted with a rearward bend 52 for aiding textual explanations.

There is a dual-arms lever (60) including a first-arm and a second-arm merging together at lever turning-point 61, the lever arms being necessarily co-turnably associated with transverse shaft 50 at 61. The two lever arms in top plan view (FIG. 5) are parallel to each other and to the vertical planes of panels 20 and 30, and herein (for reasons to be explained later) lever first-arm 62 (alignable with pedestal lip 57) is transversely rearwardly offset of lever second-arm 67. In top plan view also, arms 62 and 67 are preferably perpendicular to and co-turnably attached to shaft 50. The two lever arms as seen in front elevational view (e.g. FIGS. 2–4) are at a fixed obtuse angular relationship to each other (with the apex at turning-point 61) and preferably within the range of 135°–225°. For the FIGS. 2–5 embodiment, first-arm 62 and second-arm 67 are substantially co-linear and thus about 180°. As previously alluded to, structural elements of the operating mechanism which are laterally co-movable with the near-panel 20 should be located sufficiently remote of the travel pathway of the faster moving far-panel 30. In this vein; lever 60 might be vertically aligned with the transverse-gap between near-panel 20 and far-panel 30, transverse shaft 50 located above panels 20 and 30 and even above their respective rails (29,39), etc.

Operating mechanism 40 also includes an elongate far-link 70 having its far-end at 72 pivotably attached to the far-panel 30 at a fixed elevation located above panel mid-height (e.g. "CM"), herein the far-end pivot-pin 72 being at hanger 37A and surrounded by a roller 38 thereat. Far-link 70 has its near-end at pivot-pin 71 pivotably attached to the lever second-arm 67 a finite-distance "FD" from transverse shaft 50 (i.e. at the lever turning-poing 61).

The operating mechanism 40 also includes an elongate near-link 80 having its near-end at 82 pivotably attached to the framework at an immovable-location 85 which is nearwardly laterally offset the doorway near-edge 10B. Herein, immovable-location 85 is provided by a bracket (85) attached to and forwardly offset framework near-jamb 10N, and the transverse pivot-pin 82 thereat is located in elevation above transverse shaft 50. Near-link 80 has its far-end at 81 pivotably attached to lever first-arm 62, the distance of pivot-pin 81 from lever turning-point 61, as compared to "FD", depending partly upon the relative widths of panels 20 and 30. For example, when the near-panel and far-panel widths (e.g. "LW") respectively bear a ratio within the range of four-ninths to five-ninths doorway lateral-extent "LE", and the lever arms are at an obtuse angle of some 170°–190°, then the distance of near-link far-end 81 from lever turning-point 61 is also substantially "FD". Under optimal conditions when the panel widths are equal and the arms° angle is 180°, then the finite-distance "FD" can be limited to substantially one-fourth the doorway lateral-extent "LE", thus providing an unusually compact operating mechanism (40).

Figure 3:
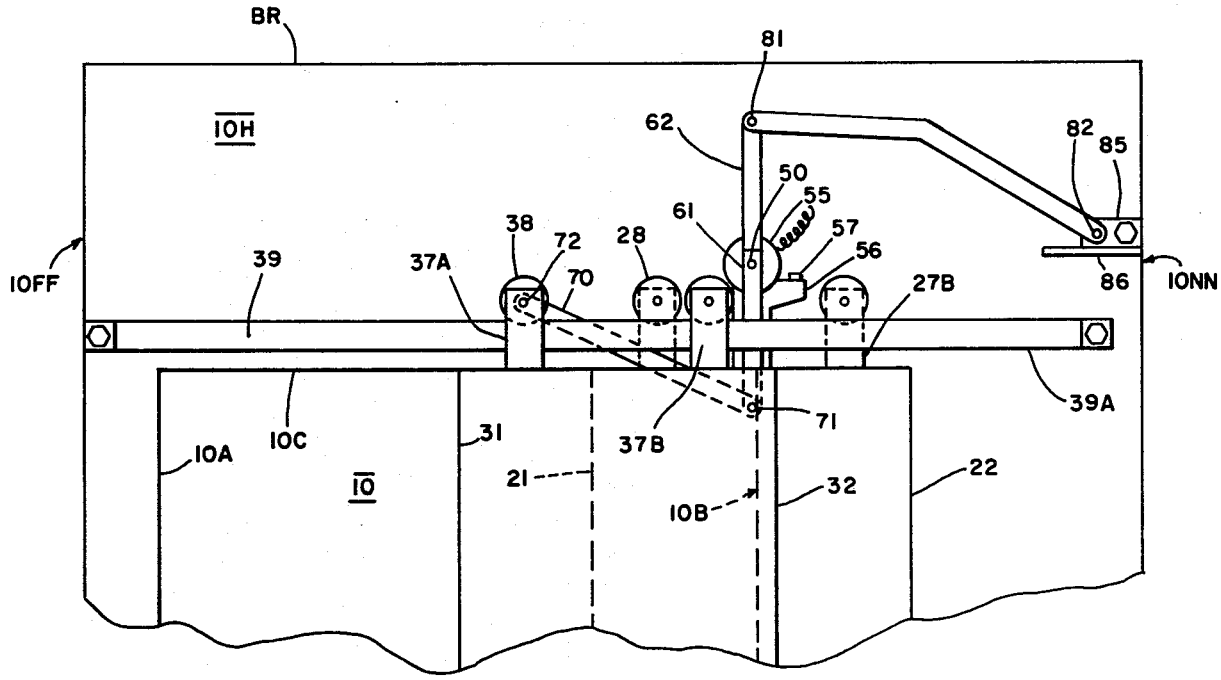
FIG. 3 is a side elevational view of the FIG. 2 embodiment at the two panels closure halfway-open condition.

It is readily apparent from FIGS. 2–5 that as shaft 50 is powerably actuated one-half turn angularly counterclockwise (as indicated at 52 in FIG. 5), the doorway closure "PC" is caused to move from fully-closed (FIG. 2) to fully-open (FIG. 4) conditions and during which time far-panel 30 has moved twice as far laterally as the slower moving near-panel 20. Conversely, as motor shaft 50 is powered for one-half revolution in the clockwise angle, doorway closure "PC" moves from fully-open (FIG.4) to fully-closed (FIG.2), and also so indicated respectively in phantom and solid lines in FIG. 5. For the faster moving far-panel 30, this might typically represent a lateral movement of three-feet during two-seconds. Though this be an average lateral speed of typically 90 feet per minute average speed, yet the far-panel terminating speeds (e.g. as farpanel lead-end 31 assumes registry with doorway far-edge 10A and near-edge 10B) are rapidly decelerating, as is considered safe practice in the elevator car industry. Obviously, the fastest panel speeds are at halfway-through the doorway lateral-extent "LE", as indicated by FIG. 3 condition.

Figure 5:
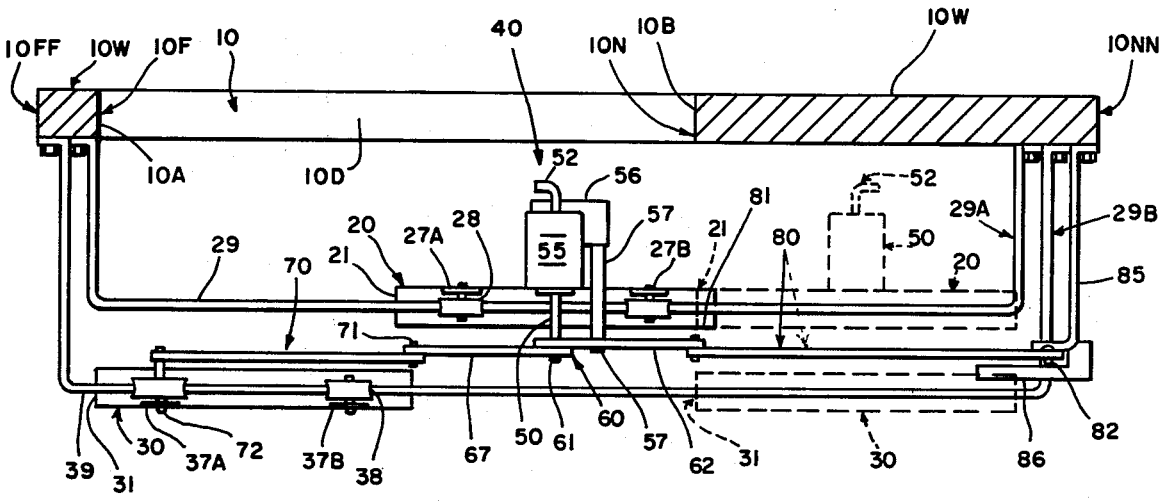
FIG. 5 is a top plan view of the FIG. 2 embodiment.
Figure 4:
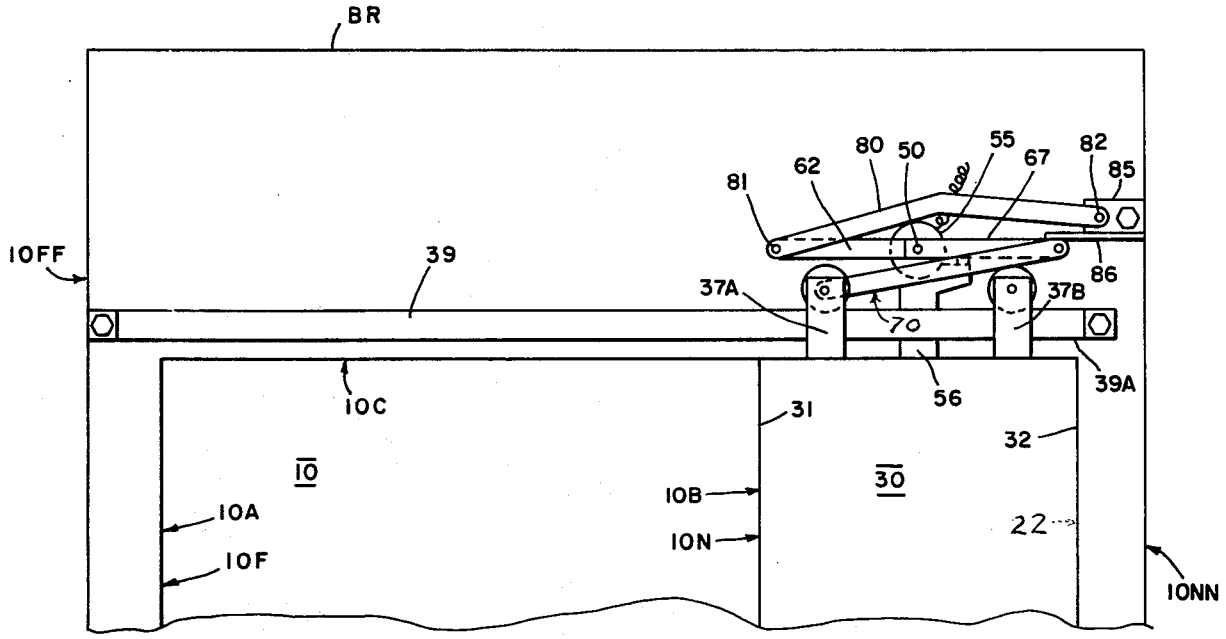
FIG. 4 is a side elevational view of the FIG. 2 embodiment at the closure "fully-open" condition.

Each such rapid acceleration, laterally extensive movement, and final deceleration of the closure panels 20 and 30 is initiated by very small and precisely controlled angular turning of the transverse shaft 50, partially affordable through a constant-speed gear reversible type dual-directional electric motor (55). However, there are stop means to limit turning of the transverse shaft 50 in both angular directions as the interdependently laterally movable panels approach fully-open and fully-closed positions. It is for such stop means that pedestal transverse-lip 57 and ledge 86(which is attached to bracket 85) might be employed. It is seen in FIG. 5 that pedestal lip 57 is transversely extensive as to be abuttable with lever first-arm 62 (but nor forwardly offset second-arm 67) as lever 60 is made to turn about turning-point 61. Ledge 86 is positioned sufficiently low to be abuttable with far-link 70(but not with rearwardly offset near-link 80) as lever 60 turns about 61. For example, at the FIG. 2 fully-closed condition, first-arm 62 downwardly abuts pedestal-lip 57 and the far-link far-end 72 remains in elevation below shaft 50; accordingly, far-door far-end 31 remains at doorway faredge 10B until shaft 50 is again powerably turned. When shaft 50 is so powerably turned (counterclockwise) by motor 55, for about onehalf turn, far-end 31 attains doorway near-edge 10A and ledge 86 abuts far-link 70 whereby doorway 10 is fully-open. Reversing the direction of motor 55 with appropriate electric switching (not shown) causes shaft 50 to turn clockwise and the fully-closed doorway condition is again attainable.

From the foregoing the construction and operation of the operating mechanism for overlapping panels type doorway closures will be readily understood and further explanation is believed to be unnecesary. However, since numerous modifications and changes in the operating mechanism will readily occur to those skilled in the art, it is not desired to limit the invention to the exact construction shown and described, and accordingly, all suitable modifications and equivalents may be resorted to, falling within the scope of the appended claims.

I claim:

1. Operating mechanism for doorway closures of the rollably suspended overlapping parallel panels type, said doorway opening framework stationarily comprising an upright near-jamb at a finite lateral-extent from an upright far-jamb and a horizontal floor and header, there being a pair of horizontal overhead parallel rails attached to the framework nearer said header than to the floor and laterally extending in excess said lateral-extent including a front-rail forwardly offset a transverse-gap of a rear-rail, the doorway closure panels above mid-height being rollably suspended from the respective rails, said closure panels including a faster moving far-panel having a finite lateral-width representing a ratio compared to doorway lateral-extent within the range of one-third to two-thirds, said operating mechanism ensuring that the closure panels move appropriately interdependently between fully-open and fully-closed positions relative the doorway opening and comprising:

A. A transversely extending shaft turnable in both angular directions about its transverse-axis, said shaft being associated with the near-panel at a fixed elevation located above mid-height and hence also laterally co-movable with said near-panel;

B. A dual-arms lever including a first-arm and a secondarm at a fixed obtuse angular relationship and merging together at a turning-point, said lever arms being co-turnably attached to the transverse shaft, said dual-arms lever and shaft being sufficiently remote of the far-panel as to not abut thereagainst during far-panel lateral movement;

C. Dual-directional powering means for turning the shaft in both angular directions about its transverse-axis;

D. A far-link having its far-end pivotably attached to the far-panel at fixed elevation located above the far-panel mid-height, said far-link near-end being pivotably attached to the lever second-arm a finite-distance from the shaft transverse-axis;

E. A near-link having its far-end pivotably attached to the first-arm and having its near-end pivotably attached at an immovable-location which is nearwardly laterally offset the doorway near-edge; and F. Stop means to limit turning of the shaft in both angular directions as the interdependently laterally movable panels approach fully-open and fully-closed positions at said framework jambs.

2. The operating mechanism of claim 1 wherein the dualdirectional powering means is attached to and laterally co-movable with the near-panel; wherein the far-panel and near-panel widths respectively bear a ratio within the range of four-ninths to five-ninths compared to doorway lateral-extent; and wherein the near-link has its far-end pivotably attached to the first-arm substantially said finite-distance from the shaft transverse-axis, said finite-distance being about one-fourth the doorway opening lateral-extent.

3. The operating mechanism of claim 2 wherein the powering means is a dual-directional electric motor attached to the near-panel above mid-height and co-movable laterally therewith; and wherein the lever first-arm and second-arm are at a fixed obtuse angle within the range of 135° to 225° and the arms lie within planes which are parallel to the planes of the parallel near-panel and far-panel.

4. The operating mechanism of claim 3 wherein the electric motor is on a pedestal and located above the rail from which the near-panel is rollably suspended, the motor having a horizontal shaft above said rail and providing said transverse shaft; wherein the first-arm and second-arm are at an obtuse angle of about 180°; wherein the pivotal connection between the far-link and far-panel is located nearer to the overhead rail than to the far-panel mid-height and below the transverse shaft; and wherein the immovable-location pivotal connection between the near-link and the framework is located in elevation above the transverse shaft.

5. The operating mechanism of claim 4 wherein the dualarms lever overlies the transverse-gap between the overhead rails; and wherein the electric motor is of the constant-speed gear reversible type.

6. The operating mechanism of claim 5 wherein the stop means to limit closure travel in one lateral direction comprises one of the lever arms being transversely offset from the other arm, one of said lever arms being adapted to abut a transverse-lip of the motor pedestal.

7. The operating mechanism of claim 6 wherein the stop means to limit closure farward travel comprises the pedestal transverse-lip underlying the lever first-arm; and wherein the stop means to limit closure nearward travel comprises a stationary ledge-stop underlying the immovable-location and adapted to abut the far-link thereat.

8. The operating mechanism of claim 2 wherein electric motor powering means is located above the rail from which the near-panel is rollably suspended, the motor having a horizontal shaft providing the said transverse shaft at the dual-arms lever turning-point; wherein the dual-arms lever overlies the transverse-gap between the overhead rails; wherein the pivotal connections between the far-link and the far-panel and the near-link and the framework immovable-location are located in elevation above at least one overhead rail; and wherein the lever first-arm and second-arm are at an obtuse angle within the range of 170°–190°.

9. The operating mechanism of claim 8 wherein the doorway framework is provided by a vertically movable elevator car.

* * * * *